US006619082B1

(12) United States Patent
Bentley

(10) Patent No.: US 6,619,082 B1
(45) Date of Patent: Sep. 16, 2003

(54) WALL MOUNT CORNER GUN LOCK ASSEMBLY

(76) Inventor: James K. Bentley, 2405 Cowper St., Cambria, CA (US) 93428

( * ) Notice: Subject to any disclaimer, the term of this patent is extended or adjusted under 35 U.S.C. 154(b) by 0 days.

(21) Appl. No.: 10/123,473

(22) Filed: Apr. 17, 2002

(51) Int. Cl.[7] ..... E05B 73/00
(52) U.S. Cl. ..... 70/58; 70/62; 211/4; 248/551
(58) Field of Search ..... 70/58–62, 14, 70/18, 19; 211/4, 8, 64; 248/551

(56) References Cited

U.S. PATENT DOCUMENTS

| | | | | | |
|---|---|---|---|---|---|
| 1,800,943 | A | * | 4/1931 | Junkunc | 70/18 |
| 4,813,252 | A | * | 3/1989 | Ray | 70/18 |
| 4,951,577 | A | * | 8/1990 | Bentley | 70/58 X |
| 5,022,536 | A | * | 6/1991 | Pierson | 211/4 |
| 5,325,686 | A | * | 7/1994 | Bentley | 70/58 |
| 5,685,239 | A | * | 11/1997 | Bentley | 70/58 X |

* cited by examiner

*Primary Examiner*—Suzanne Dino Barrett
(74) *Attorney, Agent, or Firm*—Charles C. Logan, II

(57) ABSTRACT

A wall mount comer gun lock assembly having a wall mount bracket, a wall mount bracket cover, a barrel rest, and an open loop gun ring. The wall mount bracket is installed in the corner of a room by a plurality of lag bolts that pass through apertures in the wall mount bracket. The wall bracket cover nests within the wall mount bracket and prevents access to the heads of the lag bolts. One end of the open loop gun ring is inserted through aligned apertures on the respective ends of the wall mount bracket and the wall mount bracket cover and then slid through the aligned apertures of the trigger guards of the firearms to be locked up. An elongated sliding tubular member is slid onto the tip of the open loop gun ring and the sliding tubular member has a length sufficient to close the space between the spaced tips of the open loop gun ring. A keeper member releasably connects the tips of the open gun loop ring together. The keeper member and the sliding tubular member have structure that allow the U-shaped bar of a padlock to be passed downwardly through them and locked thereby preventing removal of any of the firearms from the wall mount gun lock assembly.

16 Claims, 3 Drawing Sheets

WALL MOUNT CORNER GUN LOCK ASSEMBLY

BACKGROUND OF THE INVENTION

The invention relates to a locking assembly and more specifically to a wall mount corner gun lock assembly.

A major concern of owners of guns is the fact, children may gain unauthorized access to guns with the consequence of someone being injured or killed. Another major concern is that the guns can be stolen from a person's home.

Presently there are gun lock devices on the market that have not been entirely satisfactory. Some of these lock into the trigger guard behind the trigger thereby preventing the trigger from being engaged. Sometimes this device can be pried apart and removed. Other devices on the market allow the weapon to be secured to a wall structure. Gun cabinets that can be locked are often mounted on a wall and many of them have pane glass doors that can easily be broken and provide access to the guns.

It is an object of the invention to provide a novel wall mount corner gun lock assembly that can be easily installed and securely attached to the wall of a house.

It is another object of the invention to provide a novel wall mount corner gun lock assembly that is economical to manufacture and market.

It is a further object of the invention to provide a novel wall mount corner gun lock assembly that can be used to secure both hand guns and rifles.

SUMMARY OF THE INVENTION

Federal and state laws now require gun owners to lock up their guns to prevent misuse and firearm thefts. Few owners of firearms can afford the cost of a two to three thousand dollar gun safe. The amazing wall mount corner gun lock assembly is an inexpensive product that provides secure storage and compliance with these laws, plus protection from theft. It can be installed in the corner of a bedroom, an office, a hunting cabin or any place a person would want to store a firearm. It can hold up to six rifles, shotguns or handguns or any combination thereof.

The wall mount corner gun lock assembly has a wall mount bracket, a wall mount bracket cover and an open loop vinyl-coated steel ring that passes through the trigger guards of the guns after which they are locked with a heavy duty speciality lock. Over 2500 pounds of force is required to pry the fixture from the wall. Once the guns are secured in place, it is virtually impossible to remove the wall mount corner gun lock assembly.

The wall mount bracket would be installed in the corner of a room or closet approximately 15 inches above the floor. The wall mount bracket has four apertures through which lag bolts may be inserted so that they can be screwed in to the corner studs of the wall. After the lag bolts have been screwed into the wall, the wall mount bracket cover is lowered into a nesting position within the wall mount bracket that hides the lag bolts and prevents access to their heads. On of the tips of the open loop gun ring is slid through holes in both the wall mount bracket and wall mount bracket cover to rotate the gap of the open loop gun ring to the front. The barrel rest would be installed approximately 26 inches above the floor in the corner of a room.

The guns can now be secured to the wall mount corner gun lock assembly. The tips of the open loop gun ring is run through the trigger guards of the guns with the trigger guards facing outwardly. Each of the guns is then moved to a desired position and the barrel is leaned against the barrel rest.

To lock the wall mount corner gun lock assembly, an elongated sliding tubular member is placed on the open gun loop ring with its diametrically opposed aligned apertures vertically oriented. The sliding tubular member is then slid to either side of the gap of the gun ring. A stainless steel spring wire keeper member has its opposite ends removably inserted into holes at opposite tips of the open loop gun ring with the curved section of the keeper member properly oriented. The sliding tubular member is then slid to the center of the gap and the lock pin of a padlock is inserted downwardly through the vertically aligned apertures in the center of the sliding tubular member. The padlock is then closed and the guns are now secure and protected from theft and misuse. To remove any of the guns the procedure would be reversed.

DESCRIPTION OF THE PREFERRED EMBODIMENT

Figure 1:
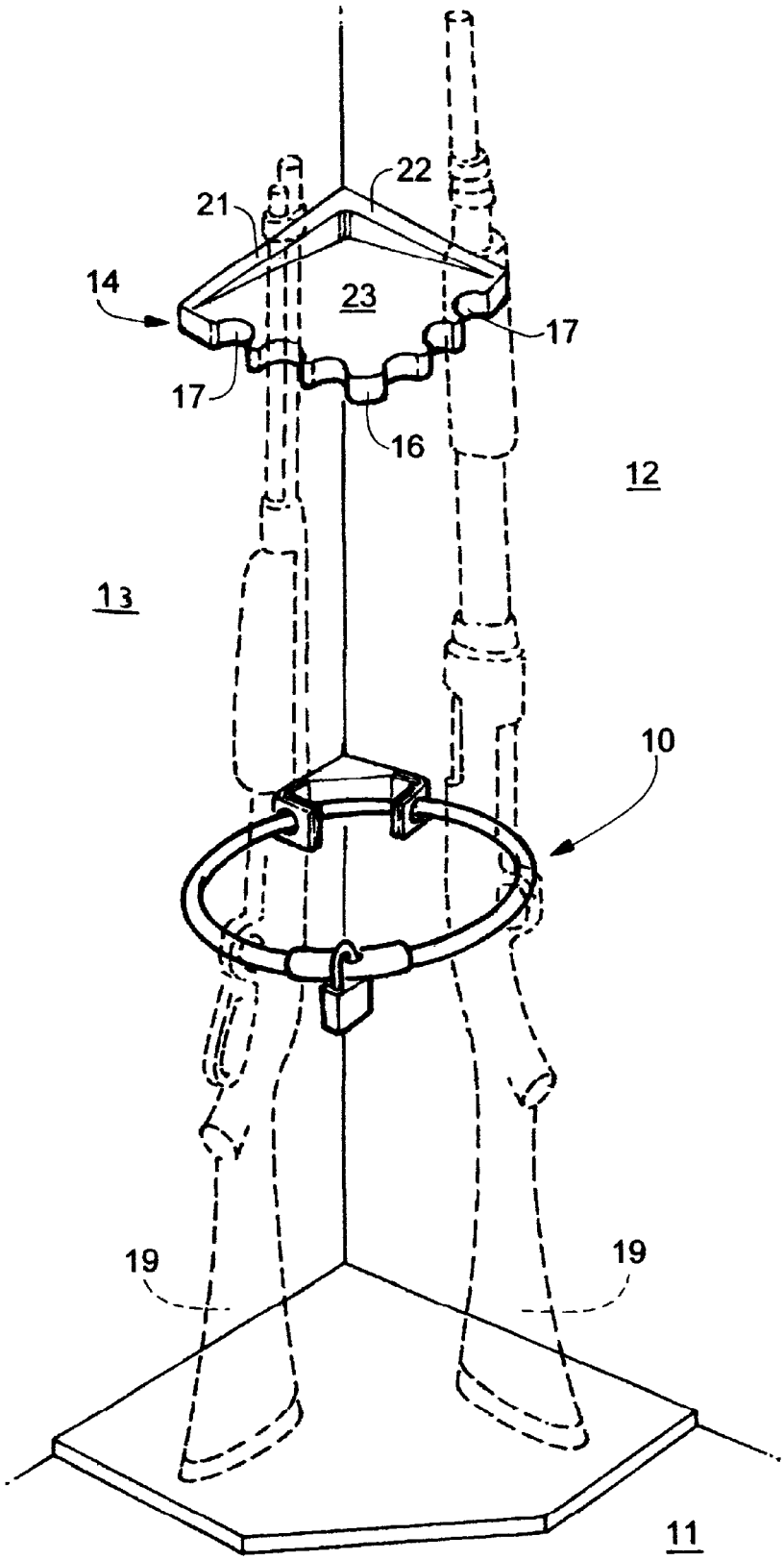
FIG. 1 is a front perspective view illustrating the novel wall mount corner gun lock assembly installed in the corner of a room.

The novel wall mount corner gun lock assembly will now be described by referring to FIGS. 1–6 of the drawings. The wall mount corner gun lock assembly is generally designated numeral 10. In FIG. 1 it is illustrated installed in a room having a side wall 12, a sidewall 13 and a floor 11 that form a corner. A barrel rest 14 is secured to the corner by a screw or bolt (not shown). Barrel rest 14 has a front wall 16 having a plurality of concave notches 17 for receiving the barrels of rifles or shotguns 19. It also has a left side wall 21, a right side wall 22 and a top wall 23.

Figure 2:
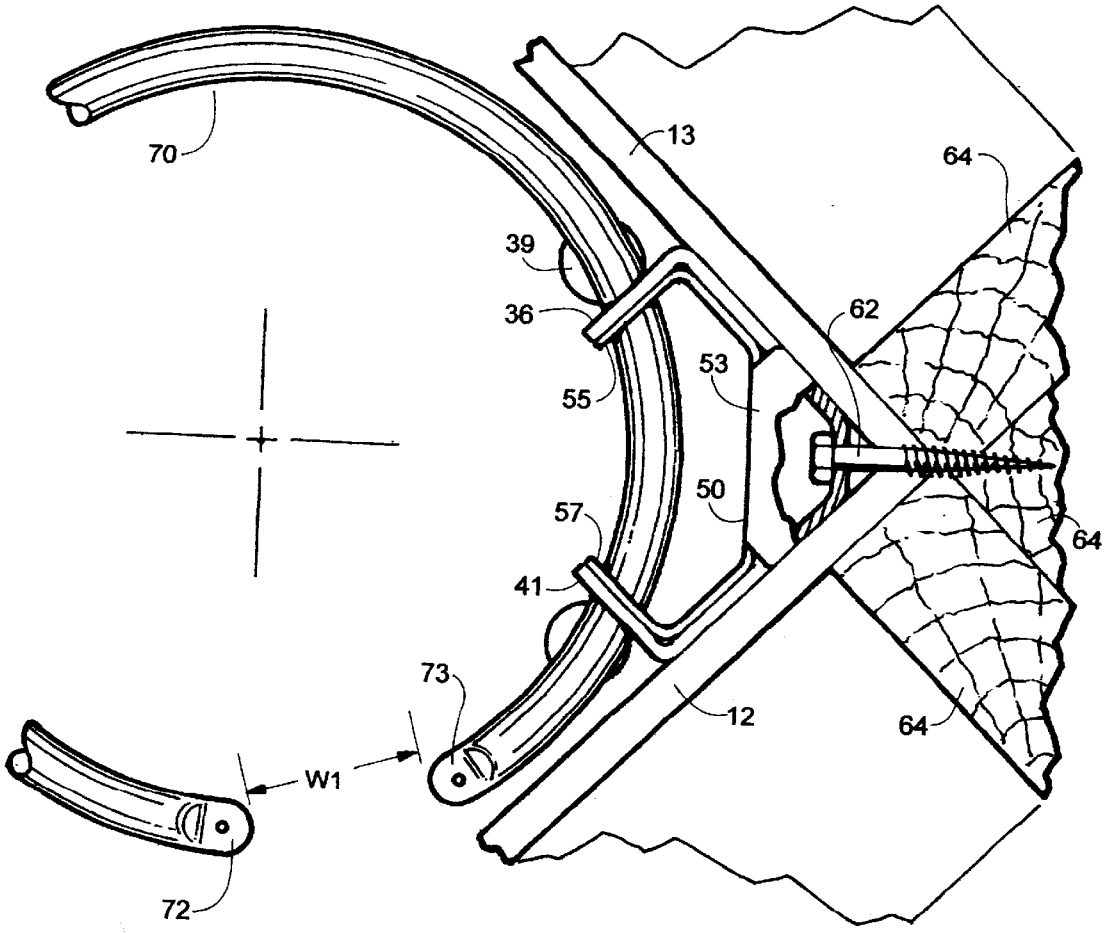
FIG. 2 is a horizontal cross section taken through the corner of the room immediately above the wall mount gun lock assembly with portions broken away.
Figure 4:
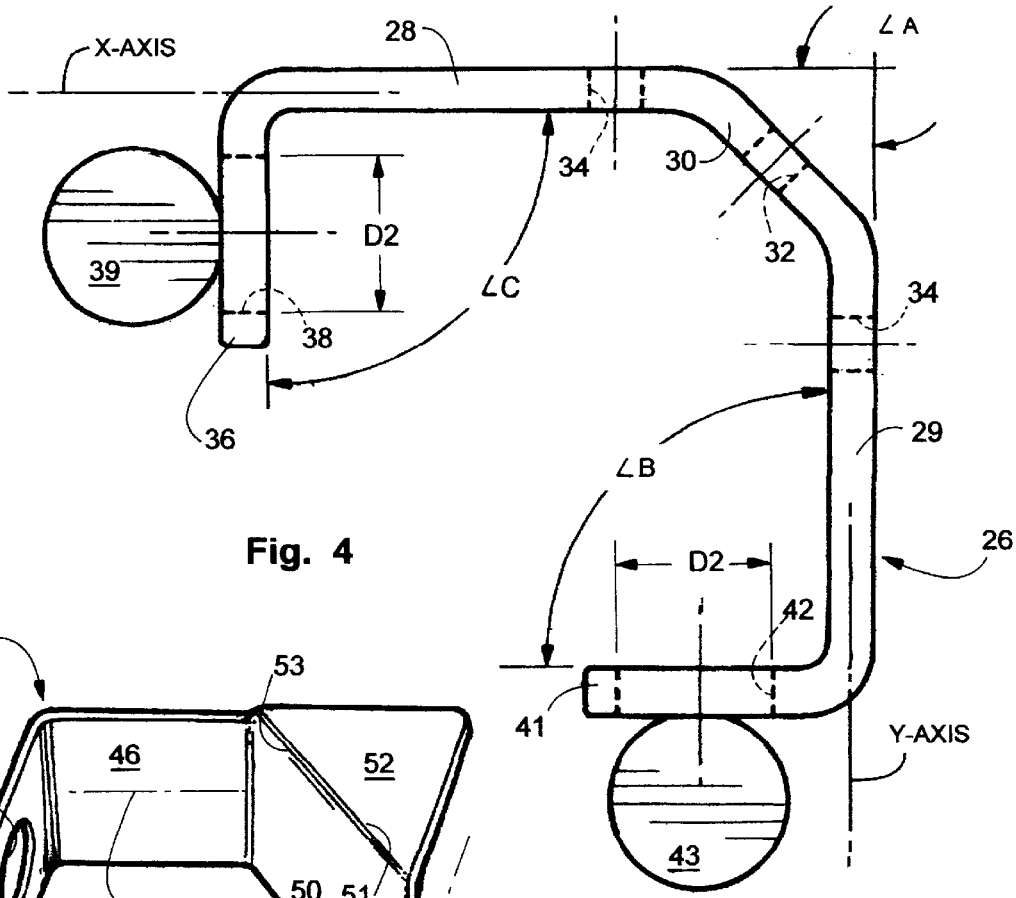
FIG. 4 is a top plan view of the wall mount bracket.
Figure 5:
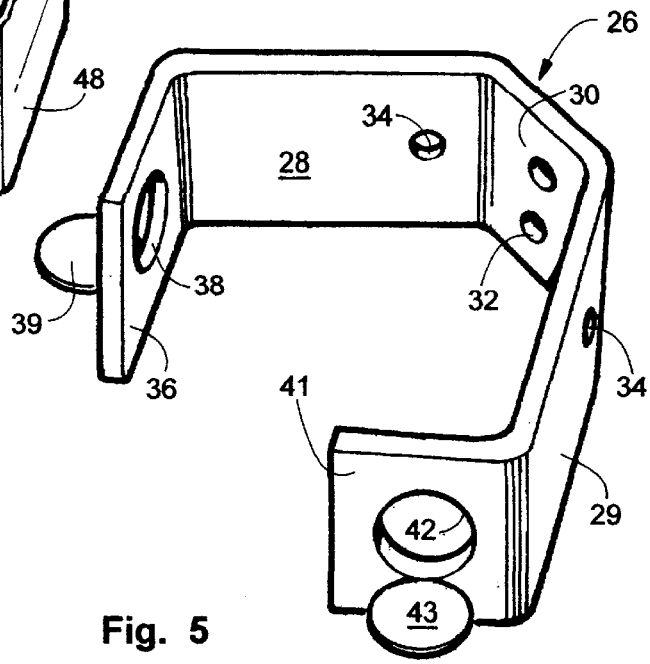
FIG. 5 is front perspective view of the wall mount bracket.

The wall mount bracket 26 is best illustrated in FIGS. 2, 4 and 5. It has a left arm member 28 having a longitudinally extending a X-axis and a right arm member 29 having a longitudinally extending axis. The X-axis and the Y-axis intersect at substantially a 90 degree angle A. A connecting member 30 has a pair of vertically spaced lag bolt apertures 32. The respective arm members also each have a lag bolt aperture 34. A left finger member 36 is connected to the front end of left arm member 28 at an angle C which is substantially 90 degrees. Left finger member 36 also has an aperture 38 and a support seat 39. A right finger member 41 is connected to the front end right arm member 29 at substantially a 90 degree angle B. Right finger member 41 has an aperture 42 and a support seat 43. Apertures 38 and 42 have a diameter D2.

Figure 6:
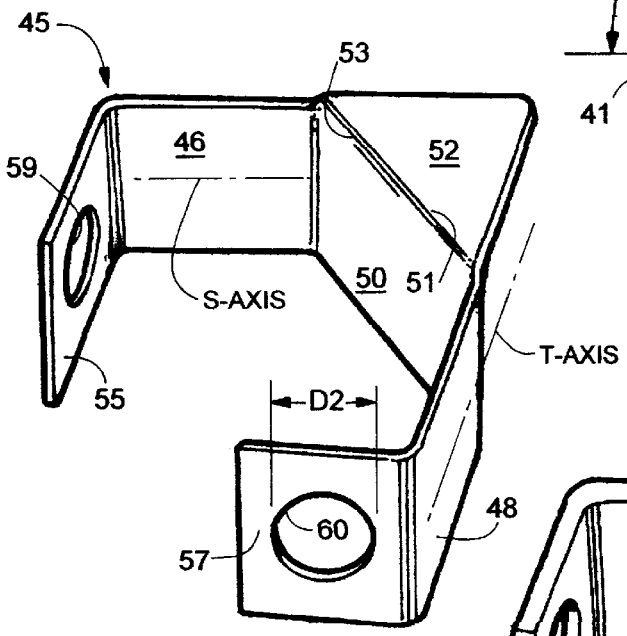
FIG. 6 is front perspective view of the wall mount bracket cover.

Wall mount bracket cover 45 is best illustrated in FIG. 6 and it has a left arm member 46 having a S-axis and a right arm member 48 having a T-axis. The S-axis and the T-axis intersect each other at substantially a 90 degree angle. A front cover wall 50 connects the rear ends of the respective left arm member 46 and the right arm member 48. Front cover wall 50 has a top edge 51 and a top cover wall 52 having a front edge 53 which extends substantially perpendicular thereto. A left finger member 55 extends substantially perpendicular to left arm member 46 at its front end and a right finger member 57 extends substantially perpendicular to the front end of right arm member 48. They have respective apertures 59 and 60 each having a diameter D2. The dimensions of wall mount bracket cover 45 are slightly smaller than those of wall mount bracket 26 so that wall mount bracket cover 45 can nest there within (see FIG. 2). One of the lag bolts 62 is illustrated passing through one of the apertures 32 and into the corner studs 64.

Figure 3:
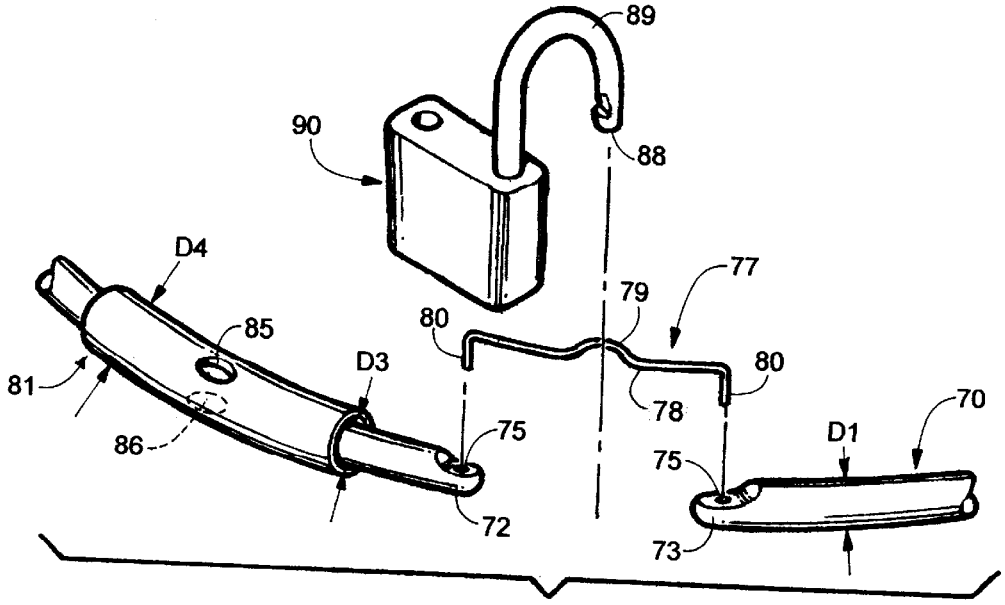
FIG. 3 is an exploded partial front perspective view of the open loop gun ring and the structure utilized for locking its tips together.

The open loop gun ring 70 is best illustrated in FIGS. 2 and 3. It has a predetermined open space W1 between left tip 72 and right tip 73. Open loop gun ring 70 has a cross-sectional diameter D1 and D2 is greater than D1 so that it can be easily slid though the respective apertures 38, 42 and 59, 60 of wall mount bracket 26 and wall mount bracket cover 45. Each of the tips 72 and 73 have a relieved top portion that has a vertically oriented bore hole 75. A wire spring keeper member 77 has an elongated body portion 78, a curved offset portion 79 and vertically oriented legs 80 that are removably engaged in the bore holes 75. Elongated sliding tubular member 81 has an inner diameter D3 and an outer diameter D4. D3 is greater than D1 and D4 is greater than D2 so that sliding tubular member 81 cannot pass through either of the respective apertures 38, 42 and 59, 60. Vertically oriented top aperture 85 and bottom aperture 86 are slightly offset from curved offset portion 79 of keeper member 77 when sliding tubular member 81 is slid over the gap or space between the tip members of open loop gun ring 70. To lock sliding tubular member 81 and prevent removal of any of the firearms, the front end 88 of the U-shaped lock pin 89 of padlock 90 is inserted downwardly through the respective apertures 85 and 86 and locked.

What is claimed is:

1. A wall mount corner gun lock assembly comprising:

a wall mount corner bracket;

a wall mount corner bracket cover;

an open loop gun ring having a diameter D1 and a predetermined open space W1 between a left tip and a right tip;

said wall mount corner bracket comprising:

an elongated left arm member having a longitudinally extending X-axis and an elongated right arm member having a longitudinally extending Y-axis; said left arm member having a front end, a rear end and an inner wall surface; said right arm member having a front end, a rear end and an inner wall surface; said X-axis being oriented at a predetermined angle A to said Y-axis; means rigidly connecting said rear end of said left arm member to said rear end of said right arm member;

a first support means on said front end of said respective left and right arm members of said wall mount bracket for releasably capturing said open loop gun ring; said first support means on said front end of said respective left and right arm members of said wall mount bracket comprises a left finger member connected to said left arm member and a right finger member connected to said right arm member; said left finger member has an aperture having a width D2 and said right finger member has an aperture having a width D2 and D2 is greater than D1 so that one of said tips of said open loop gun ring can be fed through said respective apertures; a support seat connected to said left finger member and a support seat connected to said right finger member adjacent their respective apertures for limiting downward rotation of said open loop gun ring in said apertures;

connecting means for releasably connecting said left tip and said right tip of said open loop gun ring together after said open loop gun ring has been fed through a trigger guard of one or more firearms;

locking means for releasably locking said connecting means to said open loop gun ring; and means for connecting said wall mount bracket to one or more corner studs of a room;

and an inner wall surface; said right arm member having a front end, a rear end and an inner wall surface; said X-axis being oriented at a predetermined angle A to said Y-axis; means rigidly connecting said rear end of said left arm member to said rear end of said right arm member;

a first support means on said front end of said respective left and right arm members of said wall mount bracket for releasably capturing said open loop gun ring;

connecting means for releasably connecting said left tip and said right tip of said open loop gun ring together after said open loop gun ring has been fed through a trigger guard of one or more firearms;

locking means for releasably locking said connecting means to said open loop gun ring; and means for connecting said wall mount bracket to one or more corner studs of a room.

2. A wall mount corner gun lock assembly as recited in claim 1 where D1 is in the range of 0.250–1.0 inches.

3. A wall mount corner gun lock assembly as recited in claim 1 wherein said first support means on said front end of said respective left and right arm members of said wall mount bracket comprise a left finger member connected to said left arm member and a right finger member connected to said right arm member.

4. A wall mount corner gun lock assembly as recited in claim 3 wherein said left finger member has an aperture having a width D2 and said right finger member has an aperture having a width D2 and D2 is greater than D1 so that one of said tips of said open loop gun ring can be fed through said respective apertures.

5. A wall mount corner gun lock assembly as recited in claim 1 wherein angle A is substantially 90 degrees.

6. A wall mount corner gun lock assembly as recited in claim 1 wherein said means rigidly connecting said rear end of said left arm member to said rear end of said right arm member is a connecting member having a left end and a right end.

7. A wall mount corner gun lock assembly as recited in claim 6 wherein said left end of said connecting member intersects said left arm member at an obtuse angle and said right end of said connecting member intersects said right arm member at an obtuse angle.

8. A wall mount corner gun lock assembly as recited in claim 1 wherein said wall mount bracket cover comprises: a front cover wall having a left end, a right end, a top edge and a rear surface; a left arm member having a front end and a rear end; a right arm member having a front end and a rear end; a top cover wall having a front edge; said front edge of said top cover wall is connected to said top edge of said front cover wall and said top cover wall extends rearwardly of said rear surface of said front cover wall; said rear end of said left arm member being connected to said left end of said front cover wall; said rear end of said right arm member being connected to said right end of said front cover wall; and a second support means on said front end of said respective left and right arm members of said wall mount bracket cover for releasably capturing said open loop gun ring.

9. A wall mount corner gun lock assembly as recited in claim 8 wherein said first support means on said front end of said respective left and right arm members of said wall mount bracket comprise a left finger member connected to said left arm member and a right finger member connected to said right arm member.

10. A wall mount corner gun lock assembly as recited in claim 3 wherein said left finger member has an aperture having a width D2 and said right finger member has an aperture having a width D2 and D2 is greater than D1 so that one of said tips of said open loop gun ring can be fed through said respective apertures.

11. A wall mount corner gun lock assembly as recited in claim 8 wherein the dimensions of said left arm member, said right arm member and said front cover wall of said wall mount bracket cover are such that wall mount bracket cover can be removably nested within said wall mount bracket.

12. A wall mount corner gun lock assembly as recited in claim 1 wherein said locking means comprises an elongated keeper member having a left end and a right end and means on said respective left and right ends for releasable connection to said left tip and right tip of said open loop gun ring.

13. A wall mount corner gun lock assembly as recited in claim 12 wherein said elongated keeper member has an inwardly curved offset portion intermediate said left and right ends.

14. A wall mount corner gun lock assembly as recited in claim 13 wherein said locking means further comprises an elongated sliding tubular member having an inner diameter D3 that is greater than D1 so that it can be reciprocally slid over said keeper member on said open loop gun ring to hide said keeper member; said sliding tubular member having aligned top and bottom apertures that can be aligned with said curved offset portion of said keeper member.

15. A wall mount corner gun lock assembly as recited in claim 14 further comprising a padlock having a U-shaped finger having a front end that can be removably inserted downwardly through said top and bottom apertures of said sliding tubular member so that said padlock can be locked.

16. A wall mount corner gun lock assembly as recited in claim 1 wherein said means for connecting said wall mount bracket to one or more corner studs of a room comprises at least one lag bolt aperture in said wall mount bracket at a predetermined position that would be hidden from view when said wall mount bracket cover has been nested in said wall mount bracket.

* * * * *